US009277307B2

(12) United States Patent
Conrad et al.

(10) Patent No.: US 9,277,307 B2
(45) **Date of Patent: *Mar. 1, 2016**

(54) CUP-SHAPED PORTABLE SPEAKERS AND SMART TABLET DEVICE HOLDER INTEGRATED WITH SUCH SPEAKERS

(71) Applicant: Baby Trend Inc., Ontario (CA)

(72) Inventors: Derek Conrad, Riverside, CA (US); Denny Tsai, Chino Hills, CA (US)

(73) Assignee: BABY TREND INC., Ontario, CA (US)

( * ) Notice: Subject to any disclaimer, the term of this patent is extended or adjusted under 35 U.S.C. 154(b) by 341 days.

This patent is subject to a terminal disclaimer.

(21) Appl. No.: 13/758,524

(22) Filed: Feb. 4, 2013

(65) Prior Publication Data

US 2013/0170682 A1 Jul. 4, 2013

Related U.S. Application Data

(63) Continuation-in-part of application No. 12/785,044, filed on May 21, 2010, now Pat. No. 8,369,558.

(51) Int. Cl.
*H04R 1/02* (2006.01)
*H04R 5/02* (2006.01)

(52) U.S. Cl.
CPC ..... *H04R 1/028* (2013.01); *H04R 5/02* (2013.01); *H04R 2205/021* (2013.01)

(58) Field of Classification Search
None
See application file for complete search history.

(56) References Cited

U.S. PATENT DOCUMENTS

| | | | | |
|---|---|---|---|---|
| 5,191,177 | A * | 3/1993 | Chi | B60R 11/0217 181/153 |
| 6,633,482 | B2 | 10/2003 | Rode | |
| 7,269,002 | B1 | 9/2007 | Turner et al. | |
| 7,524,197 | B2 | 4/2009 | Mills et al. | |
| 7,570,918 | B2 | 8/2009 | Chen | |
| 7,611,114 | B1 | 11/2009 | Griffin | |
| 2002/0160345 | A1 | 10/2002 | Hempton | |
| 2003/0032459 | A1 | 2/2003 | Kim | |
| 2004/0224638 | A1 | 11/2004 | Fadell et al. | |
| 2006/0250764 | A1 | 11/2006 | Howarth et al. | |
| 2007/0042709 | A1 | 2/2007 | Krieger et al. | |
| 2007/0230723 | A1 | 10/2007 | Hobson et al. | |
| 2008/0240487 | A1 * | 10/2008 | Lee | 381/387 |

(Continued)

OTHER PUBLICATIONS

Amazon, "Customer Review by 'Liz S.'—Baby Trend Expedition Double Jogging Stroller." Jul. 28, 2009. pp. 1-10.*

(Continued)

*Primary Examiner* — Curtis Kuntz
*Assistant Examiner* — Qin Zhu
(74) *Attorney, Agent, or Firm* — Chen Yoshimura LLP

(57) ABSTRACT

A smart tablet device holder incorporating two cup-shaped speakers. The housing of each speaker is shaped and sized as a cup and can be placed inside commonly seen cup holders. The two cup-shaped speakers are connected by a bridge member between them which is designed to hold a smart tablet device such as a tablet computer, an e-reader, etc. The bridge member is integrally connected with the two speakers or is a separate piece cooperating with the two speakers. The two cup-shaped speakers can be inserted into two cup holders of, for example, a parent tray of a baby stroller. The holder has electrical connectors for electrically connecting to the audio output of the smart tablet device. Two sound producing devices are disposed within each speaker housing and face upwards and downwards so that the sound can be heard by both the baby and the parent.

8 Claims, 5 Drawing Sheets

(56) References Cited

U.S. PATENT DOCUMENTS

| | | | | |
|---|---|---|---|---|
| 2008/0266783 | A1* | 10/2008 | Mills et al. | 361/686 |
| 2009/0067635 | A1 | 3/2009 | Fletcher | |
| 2009/0175458 | A1 | 7/2009 | Smith | |
| 2009/0222862 | A1 | 9/2009 | Dayan et al. | |
| 2011/0274307 | A1 | 11/2011 | Lynch | |

OTHER PUBLICATIONS

Slipperybrick, "X-mini capsule pocket-sized speaker." Aug. 5, 2007. p. 5.*

* cited by examiner

CUP-SHAPED PORTABLE SPEAKERS AND SMART TABLET DEVICE HOLDER INTEGRATED WITH SUCH SPEAKERS

BACKGROUND OF THE INVENTION

1. Field of the Invention

This invention relates to a cup-shaped portable speaker and a smart tablet device holder integrated with or cooperating with two such speakers.

2. Description of the Related Art

Various adaptors have been designed to fit into a standard cup holder to hold objects other than cups, such as music players and other electronic devices. For example, U.S. Pat. No. 7,611,114 describes a portable music player holder: "A holder for a digital audio player such as an Apple iPOD™ is designed to fit in a standard sized cup holder. The holder is configured to support the digital audio player at an easy to read angle and provides a slot for a cable such as a power cable to extend from the holder."

U.S. Pat. No. 7,570,918 describes: "A multimedia device comprises a host, which comprises a connection unit, a control unit for controlling connection of the connection unit to an external mobile electronic device to charge the connected mobile electronic device and to transmit multimedia music from the connected mobile electronic device to a FM channel of a car audio radio system for broadcasting, and a display unit controllable by the control unit to display the current operation status of the control unit, and a holder member coupled to the host and radially adjustable for securing the host to a cup holder for motor vehicle."

U.S. Pat. No. 7,269,002 describes "an apparatus that can secure an electronic device into a vehicle recess . . . . The apparatus provides a vehicle-specific integrated docking station for a digital media player, e.g. Apple's iPod. The docking station contains a connecting assembly to interface the digital media player to a digital media interface than in turn is connected to a vehicle audio system. The vehicle recess may be an ashtray recess, a change-tray recess, a cup-holder recess or other appropriate recess."

U.S. Pat. No. 6,633,482 describes "A system for installing an interactive driver information system into an existing vehicle . . . . An off-the-shelf driver-to-vehicle interface device such as a PDA is received in a corresponding docking station. A custom adapter device mechanically and electrically receives the PDA components and enables a mechanical and electrical connection from the PDA components to the vehicle. The custom adapter device is configured in a variety of embodiments to interfit with a pre-existing cavity in the vehicle such as a cup holder, ashtray cavity, coin holder, or seam in the dashboard. The custom adapter device further provides an electrical connection from the PDA components to the power system of the vehicle and to an electronic on board controller. The PDA docking station may be structurally integrated with a microphone, a speaker, and a control panel of manually operable elements to be manipulated by a driver." The PDA docking station, in which the speaker may be integrated, is not the custom adaptor that fits into pre-existing cavity in the vehicle such as a cup holder.

U.S. Pat. Appl. Pub. No. 20090222862 describes "a multimedia playing device for use in a vehicle. The multimedia playing device is mounted within the dashboard of a vehicle and is able to wirelessly transmit video to various display devices located in the vehicle. The multimedia playing device is able to accommodate any number of multimedia playing devices. The audio may be directly transmitted to the stereo system of the vehicle. In another aspect, the invention is a docking device for use in a vehicle. The docking device is adapted to be placed within the cup holder of a vehicle. An external media device is connected to the docking device in order to transmit the video and audio data. The docking device is able to wirelessly transmit video to display devices located in the vehicle. The audio may be directly transmitted to the stereo system of the vehicle and/or to the display device."

U.S. Pat. Appl. Pub. No. 20070042709 describes: "An audio device comprises a satellite receiver for receiving an audio signal via a receive antenna. A transmitter transmits the audio signal to an external receiver via a transmit antenna for remote rendering of the audio signal. A cup-shaped housing encloses the satellite receiver and the transmitter. The cup-shaped housing is configured for insertion into a cup holder to securely position the audio device inside a vehicle."

U.S. Pat. Appl. Pub. No. 20030032459 describes "a hands-free kit for mobile phones used while being mounted on a cup holder of an automobile. The hands-free kit includes a cup-shaped body, a speaker unit and a remote controller . . . . The speaker unit serves to amplify and output voice from the mobile phone, and is provided with a flexible boom for connecting the speaker unit to the body and allowing the speaker unit to be freely rotated."

U.S. Pat. Appl. Pub. No. 20020160345 describes a child cup holder that has a speaker integrated into the cup holder.

SUMMARY OF THE INVENTION

An embodiment of the present invention is a portable speaker with music player adapter, where the speaker has the general shape of a cup and can be placed in a standard cup holder.

Another embodiment of the present invention is a smart tablet device holder integrated with or cooperating with two such cup-shaped speakers.

Additional features and advantages of the invention will be set forth in the descriptions that follow and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, the present invention provides a smart tablet device holder which includes: (a) two speakers, each including: (a1) a housing having a cylindrical or tapered cylindrical outer shape, wherein a top surface of the housing defines a plurality of orifices on the top surface and a bottom surface of the housing defines a plurality of orifices on the bottom surface; (a2) first and second sound producing devices enclosed within the housing, wherein the first sound producing device is disposed near the top surface of the speaker facing upwards toward the top surface, and the second sound producing device is disposed near the bottom surface of the speaker facing downwards toward the bottom surface; and (a3) an electrical circuit disposed within the housing for controlling the sound producing devices; (b) a bridge member disposed between and mechanically connected to the housings of the two speakers, the bridge member having a support member for supporting a smart tablet device; and (c) one or more electrical connectors disposed on the bridge member or one of the two speakers and being electrically connected to the electrical circuit of each speaker.

It is to be understood that both the foregoing general description and the following detailed description are exemplary and explanatory and are intended to provide further explanation of the invention as claimed.

DETAILED DESCRIPTION OF THE PREFERRED EMBODIMENTS

Figure 1A:
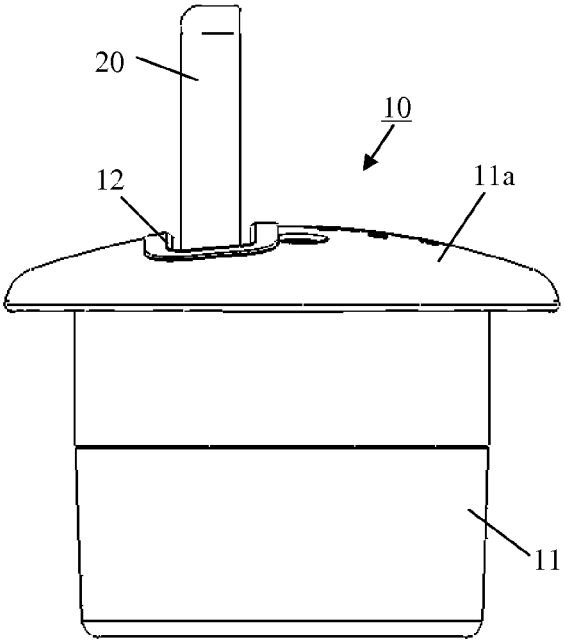
FIGS. 1*a*-1*e* are side, front, back, top and bottom views of a speaker according to a first embodiment of the present invention.
Figure 1B:
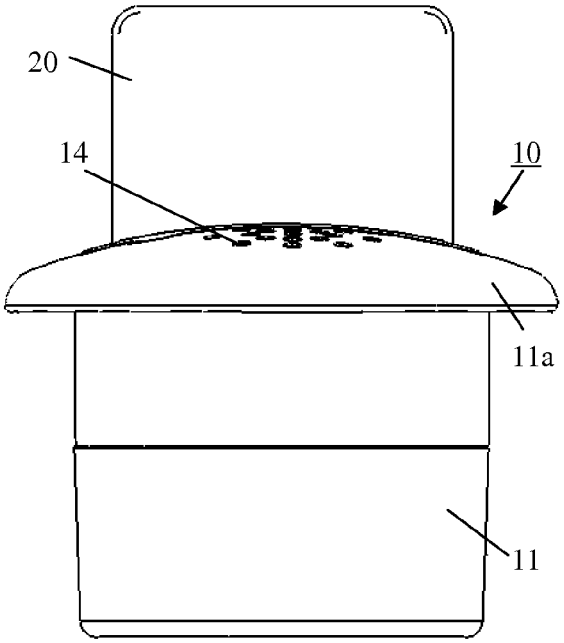
Figure 1C:
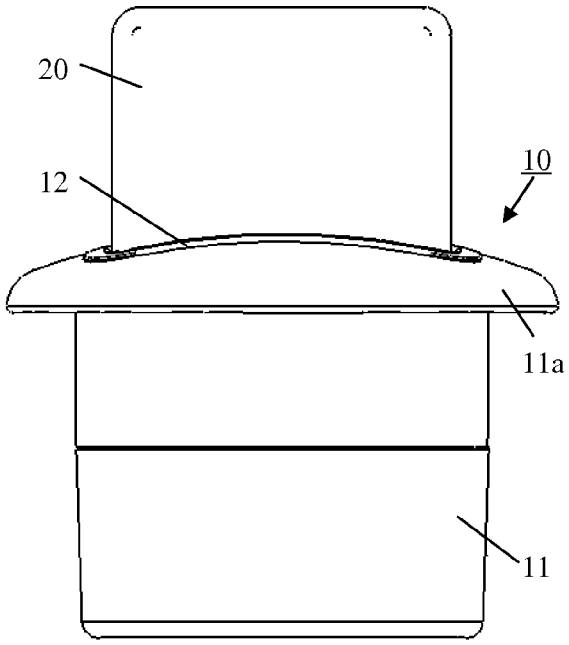
Figure 1D:
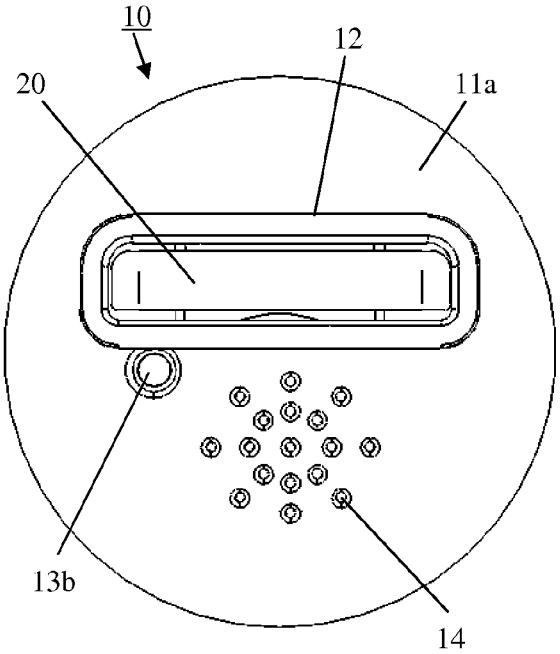

Embodiments of the present invention provides a portable speaker for a music player such as an iPod® player. The housing of the speaker is shaped and sized as a cup and can be placed inside a commonly seen cup holder, such as a cup holder in a car or other vehicles, a baby stroller, a foldable camping chair, etc. The speaker housing has a slot for receiving a music player, as well as electrical connectors for electrically connecting to the audio output of the music player. The sound producing devices are enclosed within the speaker housing and face upwards and/or downwards.

FIGS. 1*a*-1*d* are side, front, back and top views of a speaker 10 according to an embodiment of the present invention. The housing 11 of the speaker 10 has a cylindrical or slightly tapered cylindrical outer shape, with an outer diameter of approximately 2 to 3.5 inches and a height of at least 2 inches. In one particular embodiment, the housing 11 has an outer diameter of about 2.5 inches at the bottom and about 3 inches at the top, and a height of about 3 inches. The diameter of the housing 11 is selected such that the housing will fit inside a cup holder of commonly seen size without too much gap between the housing and the cup holder. Common cup holders have a diameter of approximately 2.5 to 3.5 inches. Of course, a speaker having the general shape as shown in FIGS. 1*a*-1*d* may have a larger or smaller diameter if it is designed to fit in a cup holder of a special size that is larger or smaller than commonly seen cup holders.

In a preferred embodiment, the housing 11 is made of a rigid material such as plastics. In another embodiment, the housing 11 may be made to have a layer of compressible materials such as foam or resilient materials such as spring plates on its outside, so that the housing can fit into cup holders of different sizes. In yet another embodiment, the housing may be made to have adjustable diameters.

In the particular embodiment shown in FIGS. 1*a*-1*d*, the housing 11 has a top portion 11*a* that has a larger diameter than the lower portion of the housing. When the housing 11 is inserted into a cup holder, the top portion 11*a* is above the rim of the cup holder. The shape of the top portion 11*a* is a design choice; alternatively, the top portion 11*a* may be omitted and the entire housing may have a substantially uniform diameter or a tapered shape.

A slot 12 is provided that extends from the top surface of the housing 11 into the interior of the housing for receiving a music player 20. The slot 12 may extend vertically down or may be slanted. The size and shape of the slot 12 may be designed to fit a music player of a particular size and shape, or designed to have a sufficiently large size to accommodate music players of commonly seen sizes and shapes. In one embodiment, the slot is approximately 2 to 3 (preferably 2.5) inches deep, 2.5 to 2.75 inches wide and ½ to ⅝ inches thick. The depth of the slot is not important, so long as the music player can securely sit inside the slot. The music player 20, which is not a part of the speaker 10, is inserted into the slot when the speaker is in use, and can be removed when the speaker is not in use.

Figure 2:
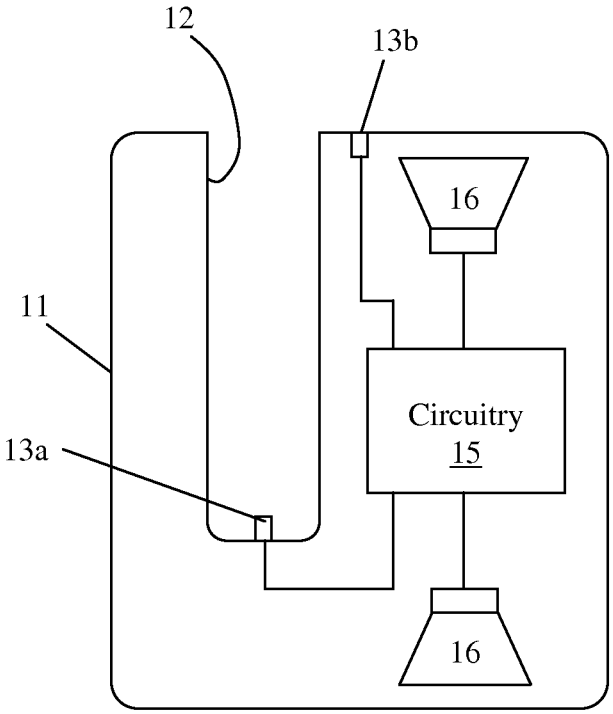
FIG. 2 schematically illustrates the internal structures of the speaker of the first embodiment.

FIG. 2 schematically illustrates the internal structures of the speaker 10. As shown in FIG. 2, one or more electrical connectors 13*a*, 13*b* are provided inside the slot 12 and/or on an outside surface (e.g. the top surface) of the housing 11. In one implementation, the speaker 10 is designed for use with a music player 20 that has a pin connector on its bottom with pre-defined mechanical and electrical specifications. A pin connector 13*a* having corresponding mechanical and electrical specifications is provided at the bottom of the slot 12 and can mate with the connector of the music player. The music player 20 is firmly inserted into the slot 12 so that the connectors of the music player and the speaker are electrically connected with each other. In another embodiment, a plug hole 13*b* is provided on the top surface of the housing 11 so that an adaptor cable (not shown) can be plugged into the plug hole to electrically connect the music player 20 with the speaker 10. The speaker 10 may have both connectors 13*a* and 13*b* or only one of them.

One or more sound producing devices 16 (sometimes also referred to as speakers), electrical circuitry 15, and batteries (optional, not shown) are housed within the housing 11. The circuitry 15, is electrically connected to the connectors 13*a*, 13*b*, receives output audio signals from the music player 20 and controls the sound producing devices. In a preferred embodiment, one sound producing device is located near the top surface of the housing 11 facing upwards. The top surface of the housing 11 is provided with a plurality of orifices 14 (see FIG. 1*d*), or is partially made of a mesh material, to facilitate the propagation of the sound. In one embodiment, a second sound producing device is provided near the bottom of the housing facing downwards, and the bottom surface of the housing 11 may also be provided with orifices (see FIG. 1*e*) or a mesh material.

In one embodiment, the speaker housing 11 has a battery compartment, so that the speaker can be used without being connected to an external power source. In another embodiment, the speaker 10 has a power cord or can receive a power cord from an external power source, such a 12V source of a vehicle.

As smart tablet devices such as tablet computer, e-reader, etc. become more widely used, there is a need for convenient holders designed to hold such devices in various situations. These smart tablet devices tend to be larger than pure music players such as iPod™ or devices such as smart phones. Second through fourth embodiments of the present invention provide smart tablet device holders that are integrated with, or cooperate with, two cup-shaped speakers, and that can be used with baby strollers, in particular, parent trays of baby strollers. A parent tray is a tray located just below the push handle of a stroller, in front of the person pushing the stroller. Some parent trays of conventional strollers are provided with two cup holders side by side for the convenience of the parent. A smart tablet device holder incorporating two cup-shaped speakers can be used by inserting the two speakers into the two cup holders of the parent tray. While the parent tray of a stroller is used as an example here, the smart device holder may also be used with the child tray of the stroller or other types of trays that have two cup holders side by side.

Figure 3:
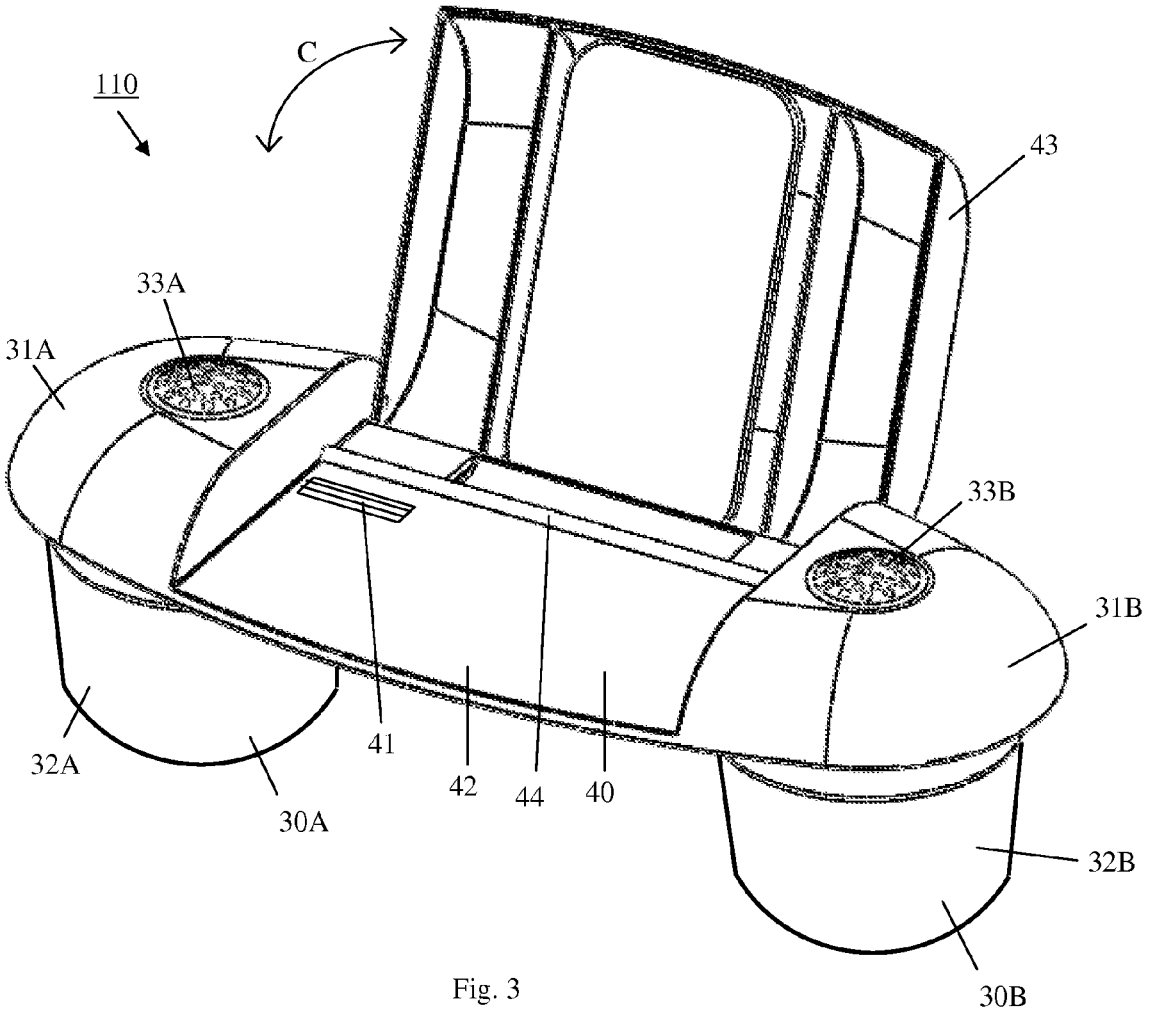
FIG. 3 illustrates an example of a smart tablet device holder integrating two cup-shaped speakers according to a second embodiment of the present invention.

FIG. 3 illustrates an exemplary smart tablet device holder integrating two cup-shaped speakers according to the second embodiment of the present invention. As shown in FIG. 3, the smart tablet device holder 110 includes two cup-shaped speakers 30A and 30B, and a bridge member 40 located between the two speakers 30A and 30B. The bridge member 40 is mechanically connected to and supported by the two speakers 30A and 30B, and may be formed integrally with the two speakers. For example, the top portions 31A and 31B of the speakers 30A, 30B and a part of the bridge 40 may be formed of one piece of material such as plastic. The two speakers 30A, 30B have cup-shaped housings 32A, 32B extending below the bridge member 40. In use, the housing 32A, 32B of the speakers are inserted into the two cup holders of the parent tray of the stroller, while the bridge piece 40 is disposed above the tray surface between the two speakers. The bridge member 40 has structures designed to hold a smart tablet device, as will be described in more detail later.

Figure 1E:
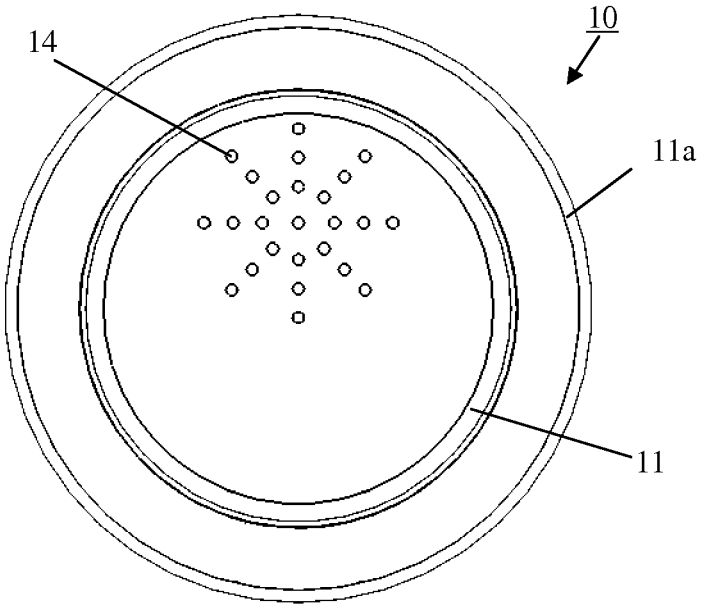

Each of the speakers 30A, 30B has a structure generally similar to the cup-shaped speaker 10 of the first embodiment shown in FIGS. 1*a*-2, except for the following differences. First, the slot 12 of speaker 10 is not necessary for the speakers 30A and 30B, because the music player (the smart tablet device) can be held by the bridge member 40. Of course, the slot 12 can still be provided to make the holder 110 more versatile. Second, the electrical connector 13*a* or 13*b* shown in FIG. 2 may now be located on the bridge member 40, such as the electrical connector 41 shown in FIG. 3. The electrical connector 41 can also be located on the top portion 31A 93 31B of the cup-shaped speaker. One such electrical connector is coupled to the electrical circuitry of both speakers 30A and 30B.

The structure of speakers 30A, 30B is otherwise similar to that of the speaker 10, including the two sound producing devices facing upwards and downwards, the orifices on the top and bottom cover of the speakers (the orifices 33A, 33B on the top surface are shown in FIG. 3), the exterior shape and size of the housing, etc.

The bridge member 40 may have various shapes; any suitable shape may be used, so long as it can stably hold a smart tablet device. In the example shown in FIG. 3, the bridge member 40 includes a flat bottom piece 42 connecting the two speakers 30A, 30B, and a top piece 43 pivotally joined to the bottom piece 42 by a hinge (not shown), so that the top piece can rotate (as indicated by the arrow C) between an open position (shown in FIG. 3) where the top piece is substantially vertical and a closed position (not shown) where the top piece is substantially horizontal and rests over the bottom piece. The rotation axis of the top piece 43 in this example is in a transverse direction, i.e. parallel to a line extending between the centers of the two speakers 30A, 30B. When the top piece 43 is open, it forms a back of the holder and the smart tablet device can be disposed upright, resting on the bottom piece 42 and against the top piece (back) 43. A ridge 44 or a groove may be provided on the top surface of the bottom piece 42 extending in the transverse direction, so that the bottom edge of the smart tablet device can rest against the ridge or sit in the groove, preventing the tablet device from sliding. Optionally, retaining devices such as clamp(s), hook(s), strap(s), elastic band(s), etc. are provided on the back 43 to securely retain the smart tablet device to the holder. The smart tablet device can be electrically connected to the internal circuitry of the speakers 30A, 30B via the electrical connector 41. When not in use, the top portion 43 may be rotated to its closed position.

In an alternative implementation, the top piece 43 is fixedly joined to the bottom piece 42 and not rotatable. The top piece is substantially vertical, forming a back of the holder. In other words, the bridge member 43 has an L-shaped cross-section.

Figure 4A:
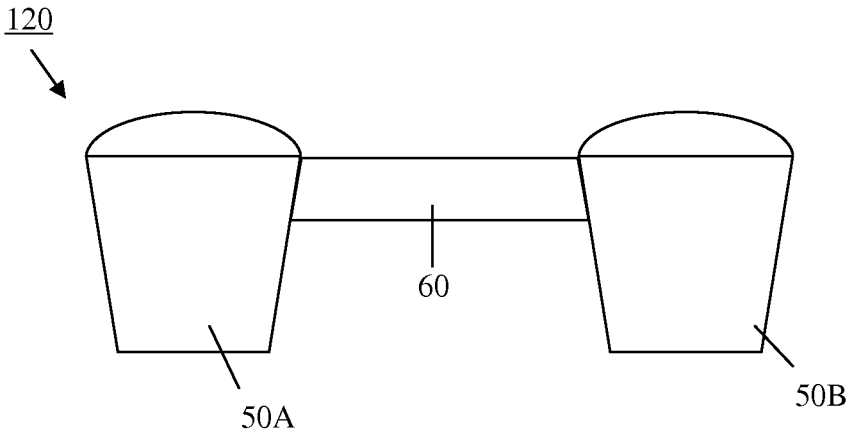
FIGS. 4*a*-4*d* schematically illustrate additional examples of a smart tablet device holder integrating two cup-shaped speakers according to a third embodiment of the present invention.
Figure 4B:
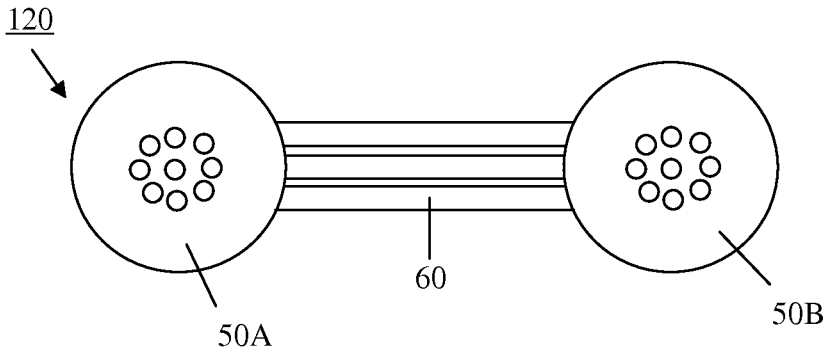
Figure 4C:
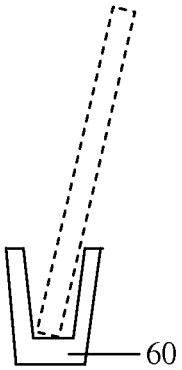

FIGS. 4*a*-4*c* schematically illustrates another example of a smart tablet device holder according to the third embodiment. This holder 120 includes two cup-shaped speakers 50A, 50B similar to the speakers 30A, 30B, and a bridge member 60 connecting the two speakers. The bridge member 60 is preferably formed integrally with the two cup-shaped speakers 50A, 50B. The bridge member 60 has an elongated shape extending between the two speakers, as shown in FIGS. 4*a* and 4*b* (front elevation view and top view, respectively), and a U-shaped cross-section as shown in FIG. 4*c*. The U-shaped cross-section forms an elongated pocket in which the smart tablet device (shown in dashed lines in FIG. 4*c*) can be held. Retaining devices such as clamp(s), hook(s), strap(s), elastic band(s), etc. may be optionally provided on the bridge member 60 to secure the smart tablet device to the holder.

An electrical connector (not shown) is provided on the bridge member 60 and/or one or both of the cup-shaped speakers 50A, 50B, and is electrically connected to the electrical circuitry of the speakers 50A, 50B.

Figure 4D:
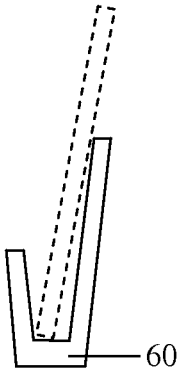

In an alternative implementation, the back panel of the bridge member 60 is made higher, forming an asymmetrical pocket, as shown in the cross-sectional view FIG. 4*d*. Such a pocket can hold the smart tablet device more securely.

Figure 5:
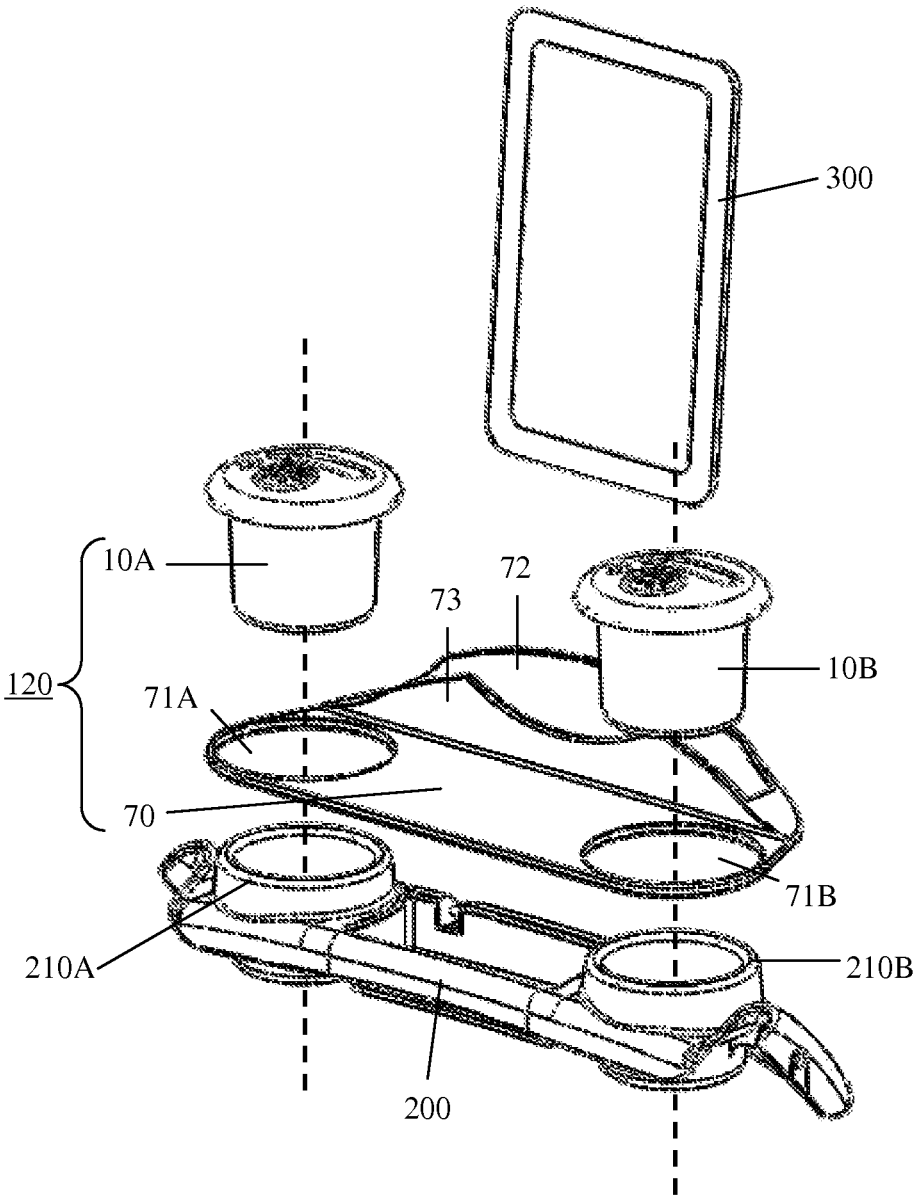
FIG. 5 illustrates another smart tablet device holder using two cup-shaped speakers according to a fourth embodiment of the present invention.

FIG. 5 illustrates another smart tablet device holder system using two cup-shaped speakers 10A, 10B and a bridge member 70 according to a fourth embodiment of the present invention. Each of the two cup-shaped speakers 10A, 10B may be identical to the sub-shaped speaker 10 of the first embodiment (see FIGS. 1*a*-2). The bridge member 70 is a separate piece, i.e., not integrated with the speakers 10A, 10B. The bridge member 70 has an elongated shape with two round openings 71A, 71B which have locations and sizes that match the locations and sizes of the cup holders 210A, 210B of the tray 210 (which is not a part of the smart tablet device holder system). This structure allows the bridge member 70 to cooperate with the two cup-shaped speakers. In use, the bridge member 70 is placed over the tray 200 so that the openings 71A, 71B are aligned with the cup holders 210A, 210B of the tray 200. The two cup-shaped speakers 10A, 10B are then placed through the openings 71A, 71B into the cup holders 210A, 210B to hold the bridge member 70 in place. Preferably, as shown in FIG. 5 as well as FIGS. 1*a*-1*c*, each speaker 10A, 10B has a top portion (11*a* in FIG. 1*a*-1*c*) that extends outwardly beyond the diameter of the housing (11 in FIGS. 1*a*-1*c*) of the speakers, so that when the speakers 10A and 10B are placed firmly in the cup holders, the bridge member 70 is sandwiched between the top rim of the cup holders 71A, 71B and the top portion of the speakers 10A, 10B.

The bridge member 70 has a holding structure located in the back (behind the two openings 71A, 71B), which is formed of two substantially vertical panels 72 and 73, disposed at a distance from each other, forming a pocket having U-shaped cross-section for holding the smart tablet device 300. The smart tablet device 300 (which is not a part of the holder system) may rest in a substantially vertical position inside the U-shaped pocket. Preferably, the bridge member 70 is formed of one piece of plastic material.

As stated earlier, bridge member of the smart tablet device holder may have any suitable shape; while two specific examples are given in FIG. 3, FIGS. 4*a*-4*c* and FIG. 5, other designs can be used and the invention is not limited to these examples.

It will be apparent to those skilled in the art that various modification and variations can be made in the speaker with music player adapter of the present invention without departing from the spirit or scope of the invention. Thus, it is intended that the present invention cover modifications and variations that come within the scope of the appended claims and their equivalents.

What is claimed is:

1. A smart tablet device holder comprising:

two speakers, each comprising:

a single housing having a cylindrical or tapered cylindrical outer shape, wherein a top surface of the housing defines a plurality of orifices on the top surface and a bottom surface of the housing defines a plurality of orifices on the bottom surface, the single housing having an outer diameter of 2 to 3.5 inches and a height of at least 2 inches;

first and second sound producing devices enclosed within the integral single housing, wherein the first sound producing device is disposed near the top surface of the speaker facing upwards toward the top surface, and the second sound producing device is disposed near the bottom surface of the speaker facing downwards toward the bottom surface; and an electrical circuit disposed within the single housing for controlling the sound producing devices;

a bridge member disposed between the housings of the two speakers, either mechanically connected to or cooperating with the housings of the two speakers, the bridge member having a support member for supporting a smart tablet device; and one or more electrical connectors disposed on the bridge member or one of the two speakers and being electrically connected to the electrical circuit of each speaker.

2. The smart tablet device holder of claim 1, wherein the bridge member is integrally connected to the housings of the two speakers.

3. The smart tablet device holder of claim 2, wherein the bridge member comprises:

a bottom piece mechanically connected to the housings of the two speakers; and a top piece pivotally joint to the bottom piece, the top piece being rotatable between an open position and a closed position.

4. The smart tablet device holder of claim 1, wherein the bridge member is a separate piece from the two speakers and cooperates with the two speakers.

5. The smart tablet device holder of claim 4, wherein the bridge member defines two openings through which the housings of the two speakers pass.

6. The smart tablet device holder of claim 1, wherein the bridge member has an L-shaped cross-section including a back.

7. The smart tablet device holder of claim 1, wherein the bridge member forms an elongated pocket for holding the smart tablet device.

8. The smart tablet device holder of claim 1, wherein the bridge member has a U-shaped cross-section forming a pocket for holding the smart tablet device.

* * * * *